US005370395A

United States Patent [19]

Izzo

[11] Patent Number: 5,370,395

[45] Date of Patent: Dec. 6, 1994

[54] GOLF SWING ANALYZING DEVICE AND METHOD

[76] Inventor: Paul Izzo, 7 Bald Rock Rd., Wayland, Mass. 01778

[21] Appl. No.: 160,959

[22] Filed: Dec. 2, 1993

[51] Int. Cl.[5] ..... A63B 69/36

[52] U.S. Cl. ..... 273/185 C; 273/58 C

[58] Field of Search ..... 273/185 C, 185 D, 58 C, 273/200 R, 200 A, 200 B, 26 E, 29 A, 184 B

[56] References Cited

U.S. PATENT DOCUMENTS

| | | | |
|---|---|---|---|
| 1,419,636 | 6/1922 | MacDonald | 273/185 R |
| 2,929,632 | 3/1960 | Moffatt | 273/185 D |
| 2,933,681 | 4/1960 | Crain | 273/186.1 X |
| 3,472,075 | 10/1969 | Oppenheimer | 273/185 R |
| 3,475,026 | 10/1969 | Cooper | 273/26 R |
| 3,529,823 | 9/1970 | Garver | 273/26 E |
| 3,827,696 | 8/1974 | Schafer | 273/200 R |
| 3,930,649 | 1/1976 | Yackel, Jr. | 273/101 |
| 4,022,476 | 5/1977 | Barton | 273/185 C |
| 4,664,375 | 5/1987 | Tetreault | 273/26 E |
| 4,739,995 | 4/1988 | Yackel, Jr. | 273/331 |
| 4,932,660 | 6/1990 | Wang | 273/185 D |
| 5,028,051 | 7/1991 | Schulz | 273/200 B X |
| 5,121,923 | 6/1992 | D'Allura | 273/185 C |
| 5,133,549 | 7/1992 | Vasquez | 273/26 E |

OTHER PUBLICATIONS

Tee-Off Golf Swing Trainer Brochure, 1 page, 1993.

The Swing Groover Brochure, 3 pages, 1987.

*Primary Examiner*—George J. Marlo

*Attorney, Agent, or Firm*—Brian M. Dingman

[57] ABSTRACT

A golf swing analyzing device and method in which a first ball is suspended for rotation about a substantially horizontal axis and a second ball is suspended at some distance from the first ball for rotation about a substantially horizontal axis to provide two spaced targets for analyzing the golf swing at two locations in the swing hitting zone.

19 Claims, 4 Drawing Sheets

GOLF SWING ANALYZING DEVICE AND METHOD

FIELD OF INVENTION

This invention relates to a device and method for analyzing a golf swing at spaced locations in the hitting zone.

BACKGROUND OF INVENTION

The "impact zone" is that portion of the golf swing during which the clubhead is in contact with the ball and thus delivering energy to the ball. It is solely responsible for the ball flight.

In order to achieve optimal clubhead alignment during the "impact zone", it is desirable to keep the clubhead square (i.e. perpendicular to the target line) and on a path toward the target during the "impact zone" and for a short distance (one to two feet) subsequent to the "impact zone". The portion of the golf swing from initial contact through this short distance subsequent to the "impact zone" during which the clubhead is square and moving toward the target is commonly referred to as the "hitting zone". In reality there can be no effect on the ball after it has left the club, however, it generally is accepted that focusing on the golf swing through the "hitting zone" will positively influence what happens during the "impact zone".

There have been a number of devices developed which claim to help a player analyze his or her golf swing. Barton, U.S. Pat. No. 4,022,476, discloses a golf practice device with a ball which is adapted to be quickly stabilized after it is hit to allow a second stroke. Wang, U.S. Pat. No. 4,932,660, discloses a golf practice device in which a ball is attached to a rigid arm. When the ball is hit the arm causes a tubular portion of the device to rotate to allow the ball to rotate. D'Allura, U.S. Pat. No. 5,121,923, also discloses a golf training device in which a ball is attached to a rigid rod that allows the ball to rotate. Schafer, U.S. Pat. No. 3,827,696, discloses a golf swing training device with a golf ball suspended by a tether from an attachment bar, and an adjustable sighting guide located between the golfer's head and the tethered golf ball. Oppenheimer, U.S. Pat. No. 3,472,075, discloses a golf simulation system with a ball on the end of a rigid arm which itself is operatively connected to some gearing which indicates whether or not the ball left the club face in a straight path. Moffatt, U.S. Pat. No. 2,929,632, also discloses a golf practice device with a tethered ball rotatably mounted to a horizontal arm. MacDonald, U.S. Pat. No. 1,419,636, discloses a test and practice apparatus for golf players with a target comprising a golf ball mounted at the upper end of a pivoted vertical stem, and a spaced secondary target constituting a rotatable dumbbell or bars, or bars that are not rotatable but that are adapted to be thrown to a horizontal position when struck by the club, in order to indicate the path of the club through the hitting zone.

The devices with a single ball do not accurately reflect the swing through the impact zone. As the club face strikes the ball, because the ball is tethered, it is forced up and away from the club face. Accordingly, the ball is forced to leave the club face long before the club face has left the hitting zone and, in fact, before it has left the impact zone. In actual play, the club compresses the ball on impact and the club face stays in contact with the ball for a period of time after initial contact. The time during which the club face is in contact with the ball is the impact zone. The path and orientation of the club face throughout the impact zone is what actually determines the flight of the golf ball. In fact, the most important club position is at the end of the impact zone when the ball actually leaves the club face: this position is primarily what dictates the ball's flight tendencies. And, the single ball devices only indicate the club face orientation at the very beginning of the impact zone, a poor indicator of the actual swing.

By analyzing the clubhead orientation and path throughout the "hitting zone" one can more accurately ascertain the effect of forces applied to the ball during the "impact zone ".

MacDonald has two or more targets which give the player an idea of the hitting zone distance and the path of the club head through the hitting zone. However, the first target does not rotate, it is simply knocked over. Accordingly, the first target gives no indication of the club velocity or direction at the beginning of the hitting zone. Although the secondary target or targets in two embodiments of the MacDonald device do rotate, their speed of rotation is irrelevant as they cannot be compared to the speed of rotation of the first target, since it does not rotate. Accordingly, the MacDonald device does not provide feedback on both the quality of the club face orientation as well as the acceleration of the club throughout the hitting zone.

SUMMARY OF THE INVENTION

It is therefore an object of this invention to provide a device and method for analyzing a golf swing throughout the hitting zone.

It is a further object of this invention to provide such a device and method which encourages a high level of concentration throughout the golf swing.

It is a further object of this invention to provide such a device and method which promotes full extension through the hitting zone.

It is a further object of this invention to encourage proper weight shift during the swing.

It is a further object of this invention to provide such a device and method which accurately determines whether the swing was true or would result in a slice or hook.

It is a further object of this invention to provide such a device and method which indicates whether there has been proper follow through in the swing.

This invention results from the realization that a golf swing can be analyzed through the entire hitting zone by providing two spaced balls both rotatable about a horizontal axis, one at the beginning and one near the end of the hitting zone, and analyzing the speed and direction of balls' rotation after they are hit as an indication of the quality of the swing.

This invention features a golf swing analyzing device and method. In one embodiment the device includes means for suspending a first ball for rotation about a substantially horizontal axis, and means for suspending a second ball, at a distance from the first ball, also for rotation about a substantially horizontal axis, to provide two spaced targets for analyzing the golf swing at two locations in the swing hitting zone. Each of the balls may be suspended with an arm for placement in the substantially horizontal axis. There may further be included a ball support for rotational engagement with the arm. This ball support may include a thick washer member. The ball may be suspended by further including a cord hanging from the ball support at one end and attached to the ball at the other end. The ball support may include a passage for the cord slightly wider than the cord to allow the cord to slide in the passage so that the ball can freely rotate in a non-vertical plane. The means of suspending the ball may include a rigid support riser bar having the horizontal arm at one end. There may further be included a base member for placement on the ground and adapted to hold the riser bar in a position to place the arm in a substantially horizontal position.

In a more specific embodiment, the golf swing analyzing device of this invention includes a base having a horizontal section for placement on the ground and a vertical section, with a pair of spaced apart openings in the horizontal section. Further included are a pair of rigid support riser bars each having a lower vertical section at one end passing through the opening in the horizontal section of the base and into the ground below, and each having an upper horizontal section at the other end. There is a thick washer member rotatably mounted on each support riser bar upper horizontal section which has an integral tab with an opening therethrough. A cord is passed through each tab opening. The cords each have a ball at their end adapted to rotatably hang the ball above the ground to present two spaced rotatable ball targets at spaced locations in the golf swing hitting zone to accurately track golf club movement and club face direction through the hitting zone.

The method of this invention includes a method of analyzing a golf swing through the hitting zone including suspending a first ball proximate the beginning of the hitting zone in such a manner that the ball when hit can rotate in various planes about a substantially horizontal axis as an indication of the club face direction on impact with the ball, and suspending a second ball proximate the end of the hitting zone in such a manner that the ball when hit can rotate in various planes about a substantially horizontal axis as an indication of the club face direction on exiting the hitting zone.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENT

This invention may be accomplished in a golf swing analyzing device which supports two balls at spaced locations, one at the beginning and one at the end of the swing hitting zone. The balls are each supported for rotation about a substantially horizontal axis in such a manner that the rotation can be in a vertical plane indicative of a true swing or a non-vertical planes indicative of poor club head direction and/or orientation at the two locations in the hitting zone.

Figure 1:
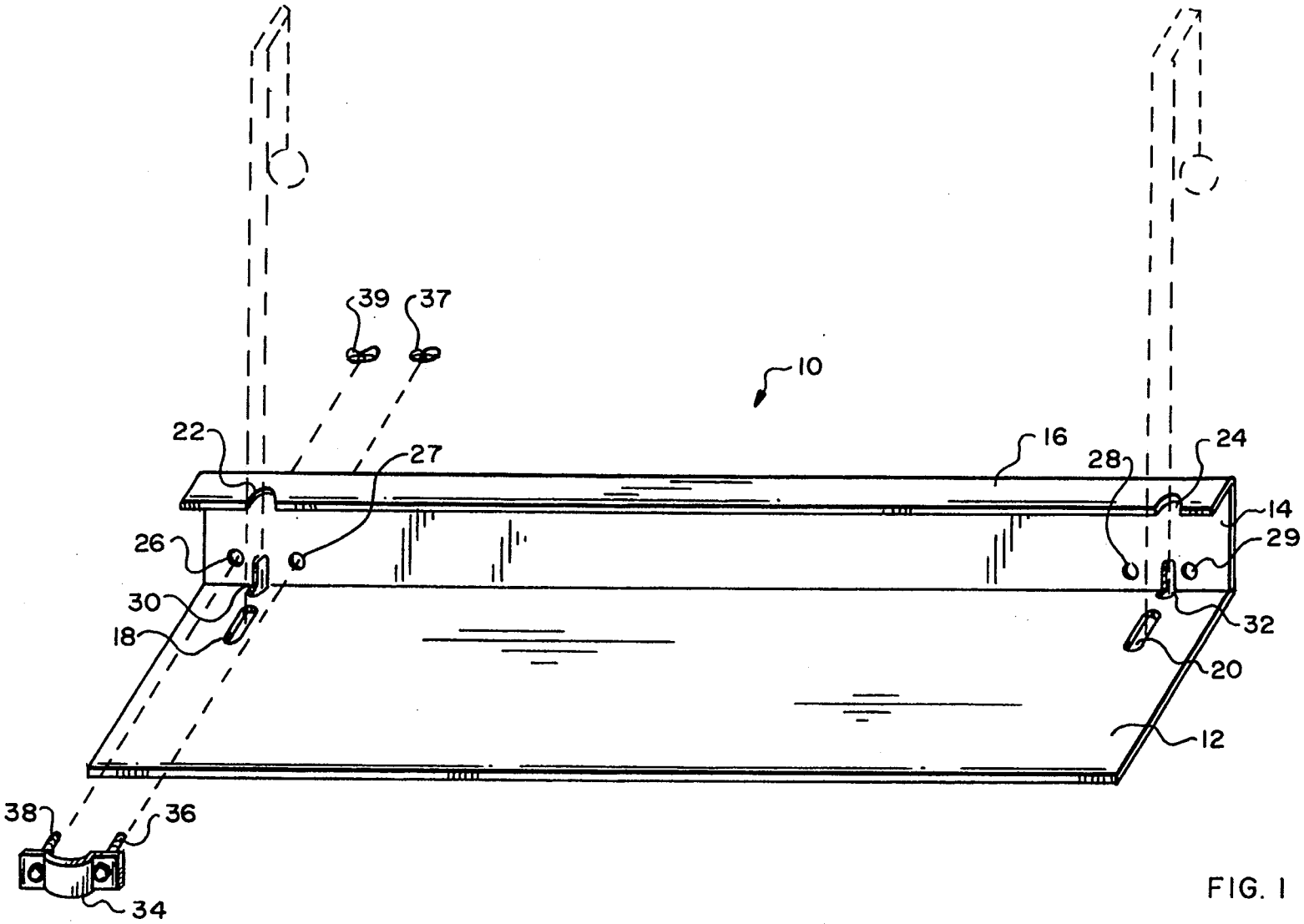
FIG. 1 is an axonometric view of the base section, with suspendent balls shown in phantom, of a preferred embodiment of a golf swing analyzing device according to this invention which is also useful for practicing the method of this invention.
Figure 3:
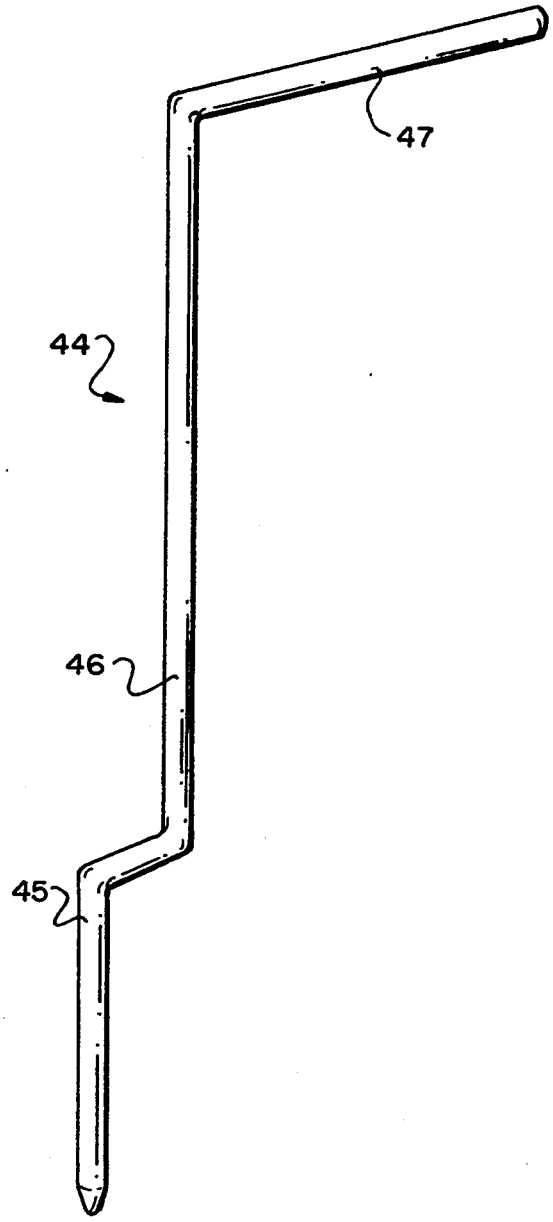
FIGS. 2 and 3 depict the rigid support riser bars which fit into the base section of FIG. 1 for hanging balls at spaced locations in the hitting zone.
Figure 6:
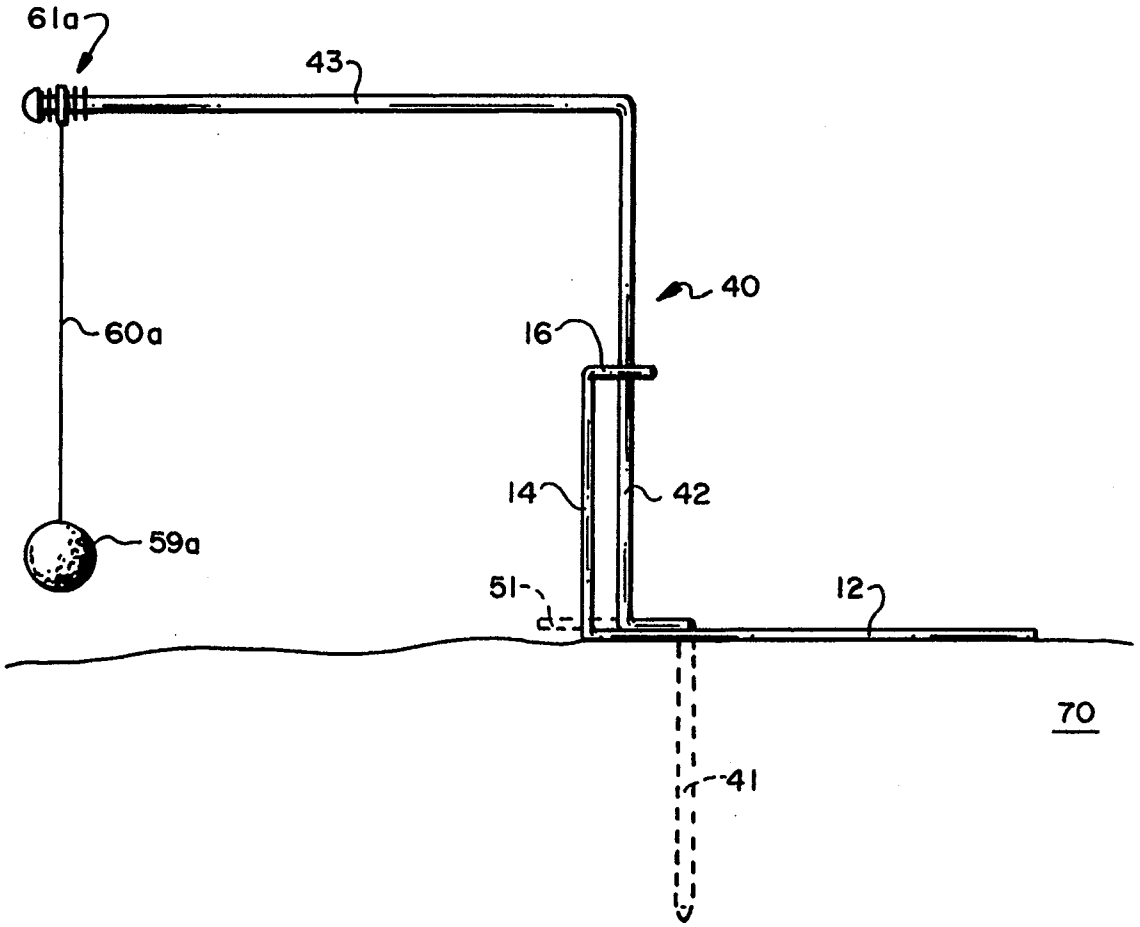
FIG. 6 is an end view of the device of this invention showing only a single ball supported for rotation about a substantially horizontal axis.

These and the other objectives of the invention are accomplished with a base member which supports spaced ball supports from which balls are hung by a cord. Base member 10, FIG. 1, is adapted to hang two balls just above the ground about 17" apart, a representative width of a golf swing hitting zone. Base 10 includes horizontal section 12 adapted to be placed on the ground or on a floor, vertical section 14, and shorter horizontal section 16 having cutouts 22 and 24 which allow the ball support rods 40 and 44, FIGS. 2 and 3, to be held upright as depicted in FIG. 6. Openings 18 and 20 allow the lower vertical section of the ball support rods to pass through plate 12 into the ground also as shown in FIG. 6. U-clamp 34 secures a ball support rod to member 10 using bolts 36 and 38 which pass through holes 27 and 26, respectively, and are secured in the holes with wingnuts 37 and 39, respectively. There is another such U-clamp arrangement for the other support rod, not shown in this drawing.

Figure 4:
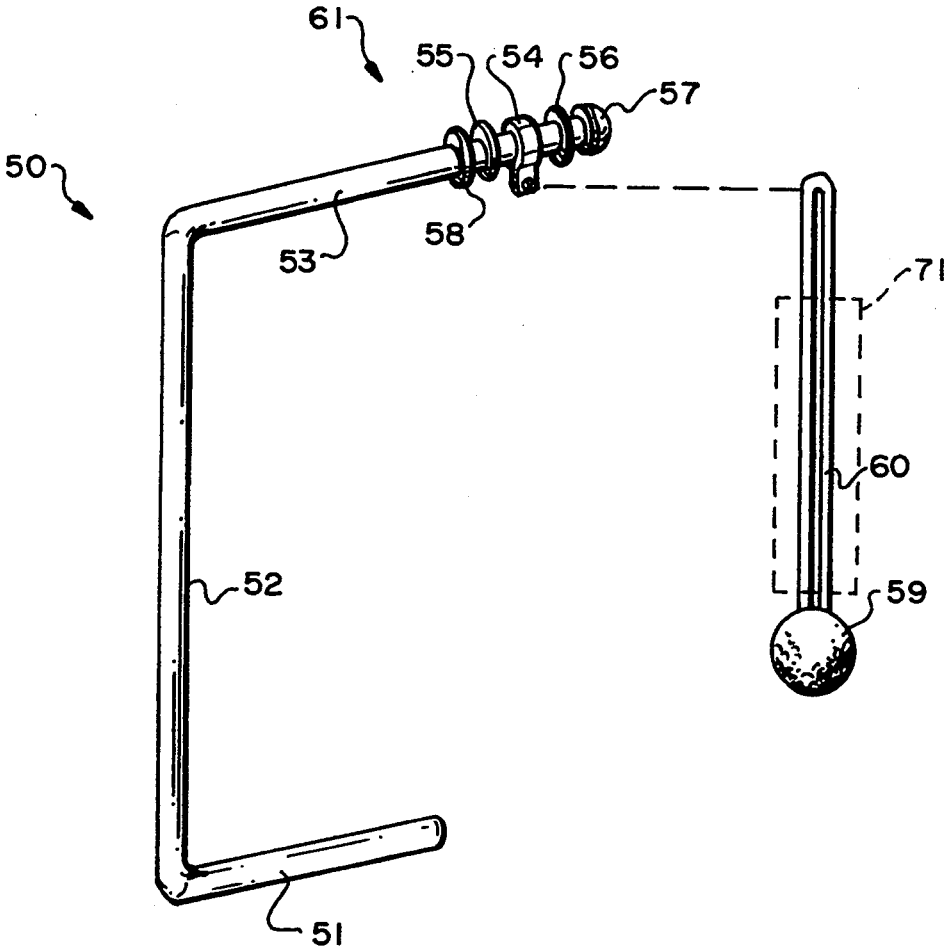
FIG. 4 depicts an alternative embodiment of a rigid support riser bar for use in this invention and also details a preferred manner of rotatably hanging the ball from the horizontal portion of the riser bar.

Openings 30 and 32 in vertical section 14 allow the use of an alternative ball support rod 50 as shown in FIG. 4 which does not pass through member 12 into the ground, but rather passes through section 14 as shown in phantom in FIG. 6 so that the device can be used on surfaces which cannot be penetrated by the other ball supports, for example inside. In this case, member 12 is preferably bolted or secured to a larger surface to add stability.

Figure 2:
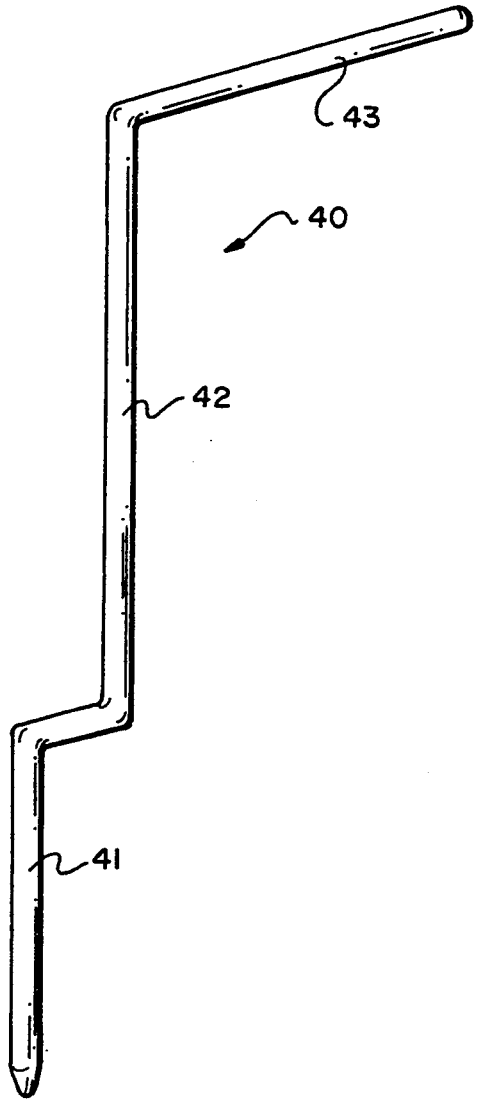

The ball at the beginning of the hitting zone would be hung from section 43 of support rod 40, FIG. 2. Section 41 would pass through hole 18 and section 42 would pass through slot 22. The ball at the end of the hitting zone would be hung from support rod 44, with lower vertical section 45 passing through hole 20, upper vertical section 46 passing through cutout 24, and upper horizontal section 47 supporting the ball. Section 46 is preferably approximately 2" longer than section 42 so that the ball at the beginning of the hitting zone sits about 2" closer to the ground than the other ball due to the fact that the club usually moves up about 2" during its traverse of the hitting zone.

Figure 5:
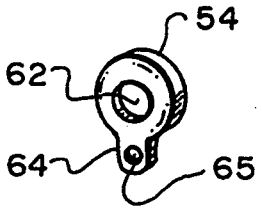
FIG. 5 is a more detailed view of the rotatable washer member of FIG. 4 which supports the cord that is attached to the ball.

The manner in which the balls are rotatably suspended from the upper horizontal sections of the support rods is shown in FIG. 4. It should be noted that support rod 50 is the alternative support rod arrangement which is not secured into the ground. Otherwise, it is identical to the rods shown in FIGS. 2 and 3. Near the end of upper horizontal section 53 is assembly 61 for hanging ball 59 from member 53 and allowing rotation of the ball about the longitudinal axis of member 53 in a vertical and non-vertical planes. Rotating ball support member 54, shown in detail in FIG. 5, includes an upper generally annular portion with hole 62 which fits over horizontal section 53 of member 50. Ball support 54 is held loosely in place using washers 55 and 56, lockwasher 58, and lock nut 57, shown spaced farther apart than they would be in practice for illustration purposes only. Ball 59 is attached to the ends of nylon cord 60 which passes through hole 65 in tab portion 64 of member 54. Cord 60 fits relatively loosely through hole 65 so it can slide therein as necessary to facilitate rotation in non-vertical planes. Plastic tubing piece 71 encloses most of cord 60 to make the cord more rigid so that it does not collapse or bend when the ball is hit so that the ball will rotate generally in a plane indicative of the direction of the club head and club face when the ball is hit.

Figures 7, 8, 9:
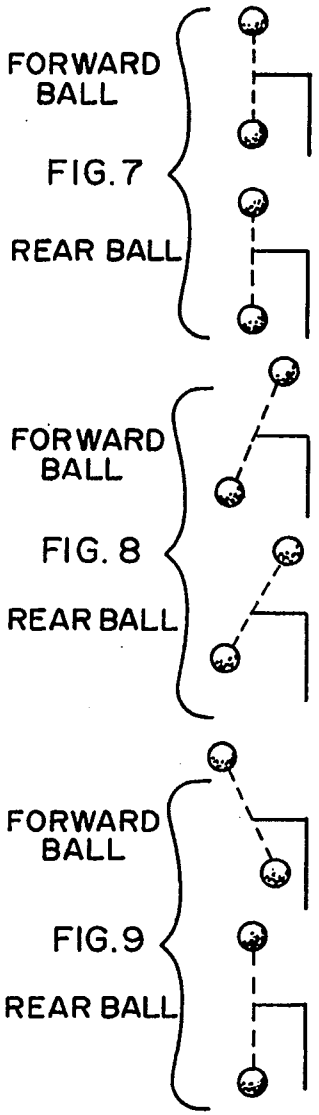
FIGS. 7 through 9 are schematic depictions of the rotational planes of the first and second balls for a true swing, a swing resulting in a slice, and a swing resulting in a hook for a right-handed hitter using the device and method of this invention.

FIGS. 7 through 9 schematically depict the rotation planes of the forward ball and rear ball of the device for a good swing, a slice, and a hook, respectively. The rear ball is positioned in the normal tee-up position, opposite the forward foot in the golf stance. The rear ball is struck in the normal fashion. As the club head continues through the hitting zone, it strikes the forward ball. By observing the simultaneous orientation of both golf balls as they rotate about a horizontal axis, the observer can detect various subtle flaws in the golf swing. If both balls rotate perpendicular to the ground as shown in FIG. 7, a good golf swing has been made. If the balls rotate in non-perpendicular planes, a problem with the golf swing is indicated. In addition, the speed of the rotation of the balls with regard to each other serves to indicate other problems such as poor follow through, sub-optimal extension throughout the swing, or failure to shift weight from the back foot to the front foot during the swing.

The balls are preferably arranged so that the rear ball is about 1" above the ground and the forward ball is about 3" above the ground. This device encourages a high level of concentration throughout the golf swing and also promotes full extension through the hitting zone, an aspect of the golf swing that greatly influences distance and accuracy. It has been found to be virtually impossible to get both balls rotating at about the same speed without making a proper weight shift. Accordingly, the device also assists in correcting weight shift problems.

Another use of the device is to teach the user to develop either a fade or a draw swing, by positioning the base member at an angle to the normal flight path. For example, if the device is positioned angling away from the user, with the forward ball slightly farther from the user than the rear ball, this will cause the user to learn a swing that will cause the ball to draw. Conversely, if the device is positioned to angle inward so that the forward ball is closer to the user than the rear ball, this will enable the user to learn a swing that will cause the ball to fade. No other such device offers such capability.

Although specific features of this invention are shown in some drawings and not others, this is for convenience only as some feature may be combined with any or all of the other features in accordance with the invention.

Other embodiments will occur to those skilled in the art and are within the following claims:

What is claimed is:

1. A golf swing analyzing device, comprising:

means for suspending a first ball for rotation about a substantially horizontal axis thereabove; and means for suspending a second ball, at a distance from the first ball, also for rotation about a substantially horizontal axis thereabove, said balls providing two spaced targets sequentially impactable by a golf club head in the club swing hitting zone for analyzing the golf swing at two locations in the swing hitting zone.

2. The golf swing analyzing device of claim 1 in which said means for suspending a first ball includes an arm for placement in the substantially horizontal axis.

3. The golf swing analyzing device of claim 2 in which said means for suspending a first ball further includes a ball support for rotational engagement with said arm.

4. The golf swing analyzing device of claim 3 in which said ball support includes a thick washer member.

5. The golf swing analyzing device of claim 4 in which said washer member is made of plastic.

6. The golf swing analyzing device of claim 3 in which said means for suspending a first ball further includes a cord hanging from said ball support at one end and attached to the first ball at the other end.

7. The golf swing analyzing device of claim 6 in which said ball support includes a passage for said cord slightly wider than said cord to allow said cord to slide in said passage so that the first ball can freely rotate in a non-vertical plane.

8. The golf swing analyzing device of claim 2 in which said means for suspending a first ball further includes a rigid support riser bar having said arm at one end.

9. The golf swing analyzing device of claim 8 further including a base member for placement on the ground and adapted to hold said riser bar in a position to place said arm in a substantially horizontal position.

10. The golf swing analyzing device of claim 1 in which said means for suspending a second ball includes an arm for placement in the substantially horizontal axis.

11. The golf swing analyzing device of claim 10 in which said means for suspending a second ball further includes a ball support for rotational engagement with said arm.

12. The golf swing analyzing device of claim 11 in which said ball support includes a thick washer member.

13. The golf swing analyzing device of claim 12 in which said washer member is made of plastic.

14. The golf swing analyzing device of claim 11 in which said means for suspending a second ball further includes a cord hanging from said ball support at one end and attached to the second ball at the other end.

15. The golf swing analyzing device of claim 14 in which said ball support includes a passage for said cord slightly wider than said cord to allow said cord to slide in said passage so that the second ball can freely rotate in a non-vertical plane.

16. The golf swing analyzing device of claim 10 in which said means for suspending a second ball further includes a rigid support riser bar having said arm at one end.

17. The golf swing analyzing device of claim 16 further including a base member for placement on the ground and adapted to hold said riser bar in a position to place said arm in a substantially horizontal position.

18. A golf swing analyzing device, comprising:

a base having a horizontal section for placement on the ground, and a vertical section, with a pair of spaced-apart openings in the horizontal section:

a pair of rigid support riser bars each having a lower vertical section at one end adapted to pass through an opening in the horizontal section and into the ground below, and each having an upper horizontal section at the other end;

a thick washer member rotatably mounted on each support riser bar upper horizontal section and having an integral tab with .an opening therethrough; and a cord passed through each tab opening and having a ball at an end adapted to rotatably hang the ball above the ground to present two rotatable ball targets at spaced locations in the golf swing hitting zone to accurately track golf club movement through the hitting zone.

19. A method of analyzing a golf swing through the hitting zone, comprising:

suspending a first ball proximate the beginning of the hitting zone in such a manner that the ball can be hit and rotate in various planes about a substantially horizontal axis thereabove as an indication of the club face direction on impact with the ball; and suspending a second ball proximate the end of the hitting zone in such a manner that the ball can be hit and rotate in various planes about a substantially horizontal axis thereabove as an indication of the club face direction on exiting the hitting zone.

* * * * *